US007337528B2

(12) United States Patent
Dunn et al.

(10) Patent No.: US 7,337,528 B2
(45) Date of Patent: Mar. 4, 2008

(54) TEXTURED DIELECTRIC PATCH ANTENNA FABRICATION METHOD

(75) Inventors: Gregory J. Dunn, Arlington Heights, IL (US); Jovica Savic, Downers Grove, IL (US); John A. Svigelj, Crystal Lake, IL (US); Nadia Yala, Schaumburg, IL (US)

(73) Assignee: Motorola, Inc., Schaumburg, IL (US)

( * ) Notice: Subject to any disclaimer, the term of this patent is extended or adjusted under 35 U.S.C. 154(b) by 397 days.

(21) Appl. No.: 11/021,444

(22) Filed: Dec. 23, 2004

(65) Prior Publication Data

US 2006/0137173 A1 Jun. 29, 2006

(51) Int. Cl.
*H01P 11/00* (2006.01)

(52) U.S. Cl. ..... 29/600; 29/825; 343/700 MS; 343/846

(58) Field of Classification Search ..... 29/600, 29/602.1, 592.1, 593; 343/700 MS, 757, 343/765, 882; 451/23, 31, 38
See application file for complete search history.

(56) References Cited

U.S. PATENT DOCUMENTS 4,801,490 A * 1/1989 Schuette ..... 428/211.1
5,307,594 A * 5/1994 Panchison ..... 451/29
5,315,753 A * 5/1994 Jensen et al. ..... 29/600
6,157,348 A * 12/2000 Openlander ..... 343/846
6,765,434 B2 * 7/2004 Mizuno ..... 327/544
7,018,418 B2 * 3/2006 Amrich et al. ..... 623/23.5
2006/0137173 A1 * 6/2006 Dunn et al. ..... 29/600

OTHER PUBLICATIONS

J. Kula, D. Psychoudakis, C.C. Chen, J.L. Volakis, J. H. Halloran "Patch Antenna Miniaturization Using Thick Truncated Textured Ceramic Substrates" IEEE 2004.
G. Kiziltas, D. Psychoudakis, J.L. Volakis, N. Kikuchi "Topology Design Optimization of Dielectric Substrates for Bandwith Improvement of a Patch Antenna" IEEE 2003.

* cited by examiner

*Primary Examiner*—Minh Trinh
(74) *Attorney, Agent, or Firm*—James A. Lamb; Valerie M. Davis

(57) ABSTRACT

A textured dielectric patch antenna is fabricated by applying a first mask pattern (310, 510, 610, 710, 915, 1015, 1210) to a first side of a solid panel made of a first material that is a ceramic dielectric and then sandblasting the solid panel through the first mask pattern from the first side to at least partially generate a shaped cavity (315, 920, 1040). The shaped cavity of the solid panel may be filled with a second material (330, 740). The first and second materials have substantially differing dielectric constants. The first side and second side of the solid panel are metallized (325), forming a patch antenna. The shaped cavities can be made more complex by using additional masking and/or sandblasting steps.

14 Claims, 8 Drawing Sheets

TEXTURED DIELECTRIC PATCH ANTENNA FABRICATION METHOD

FIELD OF THE INVENTION

The present invention is in the field of antennas, and more specifically in the field of textured dielectric patch antennas.

BACKGROUND

Patch antennas that are each formed from a panel of high dielectric constant, low loss dielectric material that is metallized on both sides are well known. More recently there has been described a type of patch antenna that uses what are known as textured dielectric flat panels to improve the performance of the patch antenna. A textured dielectric flat panel for a patch antenna is typically described as a flat panel that comprises three dimensional regions, each region formed from a low loss dielectric, there being at least two dielectric materials having substantially different dielectric constants used to form the patch antenna. The composition of the flat panel may be termed a metamaterial dielectric. Antennas of recent description use two low loss dielectric materials having such dielectric constant values as 100 and 10. The three dimensional regions may be designed using simulation programs that use randomness to generate shapes of the three dimensional regions until certain desired criteria of bandwidth, gain versus frequency, and/or radiation pattern are optimized.

The dielectric material needed to achieve a high dielectric constant, low loss characteristic is typically ceramic. The current technique used to achieve a three dimensional region having a desired shape is to form the shape in enlarged form from a mixture of ceramic particles and a polymer binder, and subsequently fire the shape to burn off the polymer binder and sinter the ceramic particles into a solid ceramic shape. This method limits the choice of materials to those available in fireable powders, for example from LTCC (Low Temperature Co-fireable Ceramic) materials suppliers. The use of a wider variety of materials of varying dielectric constant and lower loss is desirable. The firing step presents significant challenges in maintaining dimensional fidelity to the computer-generated design, because gross shrinkage occurs (25% or more is typical of LTCC), with concomitant warping and cracking problems, particularly for complex, non-solid shapes such as those required here.

BRIEF DESCRIPTION OF THE DRAWINGS

The present invention is illustrated by way of example and not limitation in the accompanying figures, in which like references indicate similar elements, and in which.

Figure 1:
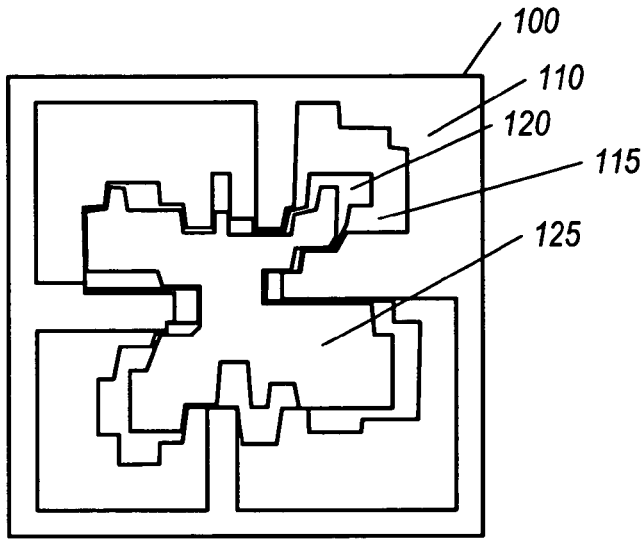
FIG. 1 is a plan view of a partially fabricated textured ceramic dielectric, in accordance with some embodiments of the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE DRAWINGS

Before describing in detail the particular patch antenna in accordance with the present invention, it should be observed that the present invention resides primarily in combinations of method steps and apparatus components related to patch antennas. Accordingly, the apparatus components and method steps have been represented where appropriate by conventional symbols in the drawings, showing only those specific details that are pertinent to understanding the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

A "set" as used in this document, means a non-empty set (i.e., comprising at least one member). The term "another", as used herein, is defined as at least a second or more. The terms "including" and/or "having", as used herein, are defined as comprising. The term "coupled", as used herein with reference to electro-optical technology, is defined as connected, although not necessarily directly, and not necessarily mechanically.

Referring to FIG. 1, a plan view of a partially fabricated textured ceramic dielectric 100 is shown, in accordance with some embodiments of the present invention. The example shown is approximately 25 millimeters (mm) square, and has been designed for use in the 1-3 GHz range. The exemplary, partially fabricated textured ceramic dielectric 100 is similar in form to a sample shown in a technical paper entitled "Topology Design Optimization of Dielectric Substrates for Bandwidth Improvement of a Patch Antenna", by G. Kiziltas et al. from the IEEE Transactions on Antennas and Propagation, Vol. 51, No. 10, October 2003, on page 2741. The sample in the technical paper was fabricated using a conventional method. The ceramic dielectric may be lead titanate, strontium titanate, barium titanate, lead zirconium titanate, or a chemical or physical combination of such materials and other metal oxide ceramics, which are well known in the art to provide high dielectric constant and low dielectric loss, and stable properties over temperature. The textured ceramic dielectric 100 has been uniquely textured by sandblasting a fired, solid panel of high dielectric constant, low loss ceramic, such as one having a dielectric constant over 50 and loss tangent under 2%, using three mask patterns having patterned openings such that the smallest openings are the deepest. When completed to the stage shown in FIG. 1, there are four surfaces 110, 115, 120, 125 visible in the plan view, which form a shaped cavity. There are a variety of methods to use sandblasting to accomplish the texturing, which are described in more detail below. After the textured dielectric 100 has been fabricated to this stage, the shaped cavity formed by the textured opening may be filled with a second material having a second dielectric constant, which may be a low loss material also, and may have a substantially lower dielectric constant, such as 3, and typically less than 20. The second material may be a material that is formed into a solid fill, such as an epoxy material. Other materials could be used, of which one example is air. In this document, the term "solid panel" is used for the ceramic panel throughput the processes of forming the cavities and filling them.

When the shaped cavity of the solid panel has been filled (if it is to be filled with other than air), the two sides of the filled solid panel are metallized. Any known or new method that is compatible with the first and second dielectric materials may be used to metallize the sides of the filled solid panel, such as lamination or electroplating. The resulting device is a patch antenna. As is known, the choice of texturing and dielectric constants can be designed to optimize the bandwidth, radiation pattern, and gain of the antennas when a radio signal is coupled to the metallization on one side and the other side is grounded. Although only one shaped cavity is shown in FIG. 1, the texturing could be of a type such that a plurality of shaped cavities are formed, and although the shaped cavity is not shown as going through the solid panel in the example shown in FIG. 1, any number of the shaped cavities in a textured solid panel may have a portion that extends completely through the solid panel. At least one reason for a portion to be extended all the way through is to provided a portion of the second material into which a plated through hole can be fabricated that couples one of the metallized sides to an isolated solder pad on the other side, to provide convenient connection to the patch antenna. Cross sectional diagrams will be used in the remainder of this document to illustrate methods of fabricating the patch antenna according to the present invention. For simplicity of explanation, several simple one or two stage cavities will be shown. Once understood, the methods illustrated can easily be extended by one of ordinary skill in the art, by repetition and mixing of steps, to achieve complex textures.

Figure 2:
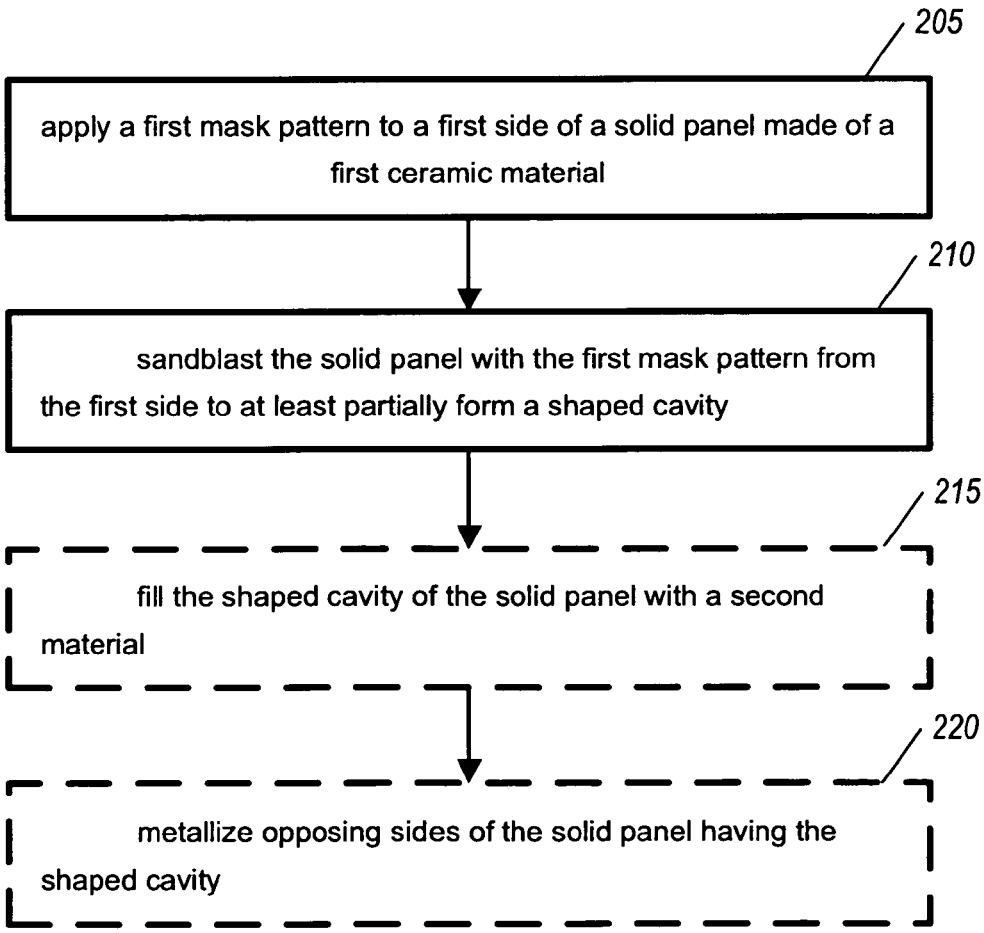
FIG. 2 is a flow chart that shows some steps of methods used to fabricate a textured dielectric patch antenna, in accordance with some embodiments of the present invention.

Referring to FIG. 2, some steps of methods used to fabricate a textured dielectric patch antenna are shown, in accordance with some embodiments of the present invention. At step 205, a first mask pattern is applied to a first side of a solid panel made of a first material that is a ceramic dielectric. The solid panel with the first mask pattern is sandblasted through the first mask pattern from the first side at step 210 to at least partially form a shaped cavity. In some embodiments, the cavity (which may be one of a plurality) is completely shaped by the end of step 210. In other cases illustrated in more detail below, additional masks are applied. When the cavity is completely shaped, the shaped cavity is optionally filled with a second material at step 215. As stated above, this step is not needed when the second material is air. This step may also not be needed if the entity that fabricates the textured solid panel ships it to a second entity for completion. At step 220, the opposing sides of the solid panel are optionally metallized. When the shaped cavity is filled with a non-solid material, the metallization may have to be a foil or other metallization material that can maintain a flat shape during fabrication and operation of the patch antenna. This step is shown as optional because the entity that fabricates the textured solid panel may ship it to a second entity for metallizing and/or filling. The second entity would then perform step 220, and possibly step 215.

Figure 3:
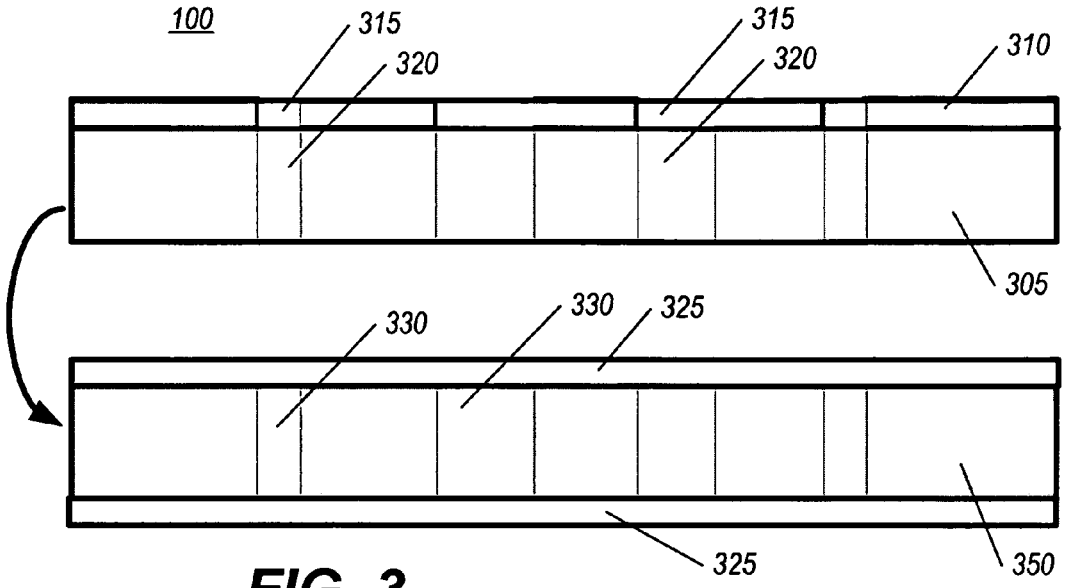
FIG. 3 is a cross sectional drawing of a solid panel in two stages of fabrication, in accordance with some embodiments of the present invention.

Referring to FIG. 3, a cross sectional drawing of a solid panel in two stages of fabrication is shown, in accordance with some embodiments of the present invention. The solid panel 305 is shown at a stage after sandblasting through the mask pattern has been completed as described with reference to FIG. 2. The solid panel 305 at this stage comprises a mask pattern 310 on a first side of the solid panel 305, four openings 315, and four cavities 320 that have been sandblasted all the way through the solid panel 305. For some embodiments in which the mask pattern is intended to survive the sandblasting, that is to say embodiments in which the openings of the mask pattern do not substantially increase throughout the sandblasting, the mask pattern 310 may be a conventional photopatterned vinyl mask used for sandblasting of decorative glass articles, or a conventional photopatterned polymer "resist" material that can be used for patterning metal layers of printed circuit boards such as DuPont Platemaster dry film resist. For a ceramic dielectric that is 1 mm thick, the polymer has been shown to survive when it is on the order of 0.5 mm thick and alumina particle sandblasting is used. After the stage illustrated by the solid panel 305, the mask pattern is removed. For the polymers described, this can be done using a conventional organic solvent or aqueous solution. After the mask pattern is removed, the second material is used to fill the shaped cavities. The second material may be a liquid, a B-stage solid polymer, ceramic filled polymer, or formed ceramic. When there are shaped cavities that go all the way through the solid panel and the second material is applied as a liquid, a backing may have to be temporarily applied to the second side of the solid panel while the second material solidifies. After the shaped cavities 320 are filled, metallization: 325 is applied to both sides of the solid panel, which is illustrated as solid panel 350, having second material 330 in the shaped cavities.

Figure 4:
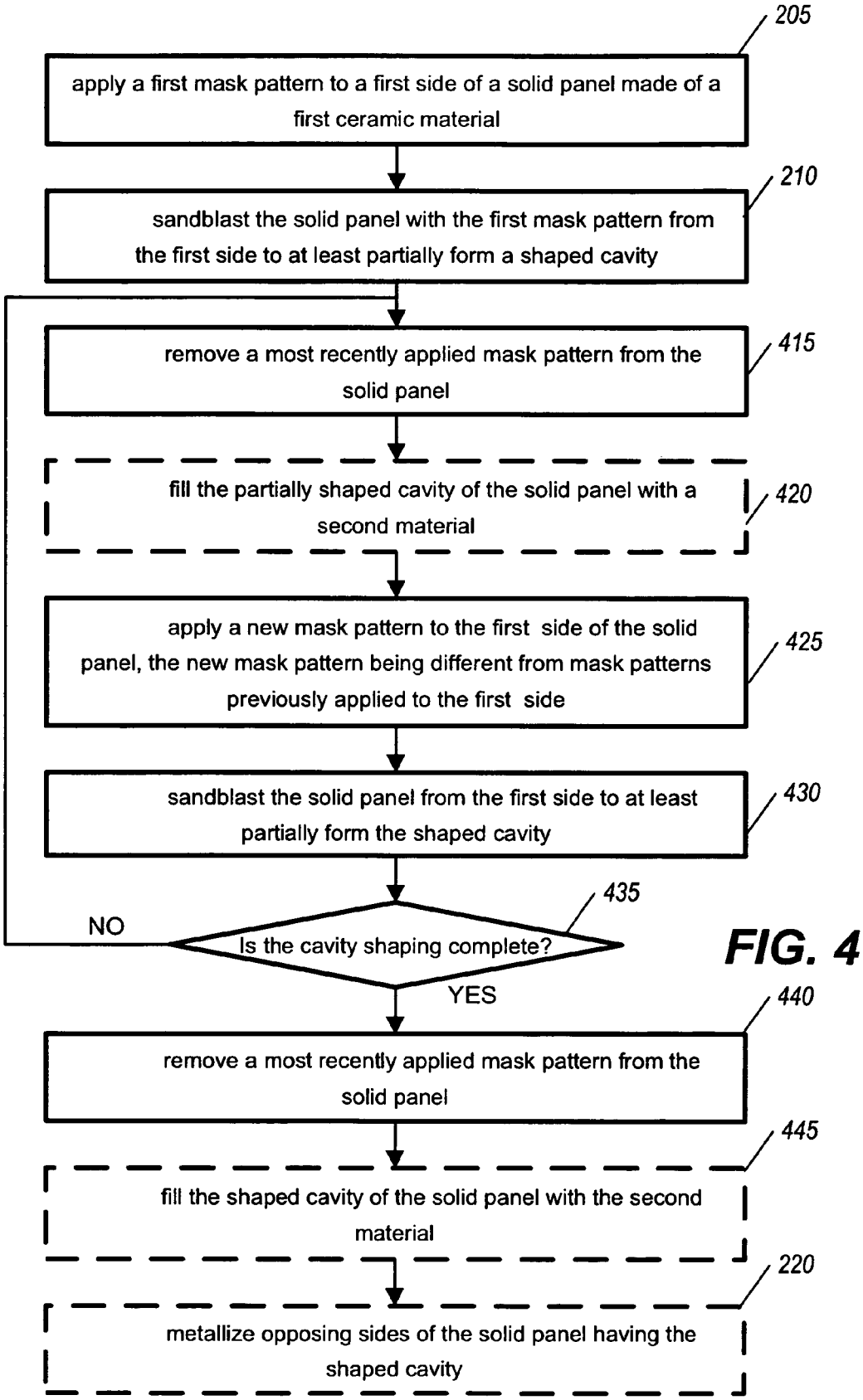
FIG. 4 is a flow chart that shows some steps of methods used to fabricated a textured dielectric patch antenna, in accordance with some embodiments of the present invention.

Referring to FIG. 4, some steps of methods used to fabricate a textured dielectric patch antenna are shown, in accordance with some embodiments of the present invention. Steps 205 and 210 are performed as described with reference to FIG. 2, using materials as described with reference to FIG. 3, partially forming at least one shaped cavity of one or more shaped cavities. The first mask pattern is removed at step 415 after sandblasting, as described with reference to FIG. 3. In some embodiments, the partially shaped cavities are filled with a second material at step 420. This may be the same material that will be used to ultimately fill the fully shaped cavities, and may be the same as the second material described with reference to FIG. 3. Filling with the second material at this step provides a flat surface for the next step. "Filling" as described throughout herein means filling the partially or fully shaped cavities so that the second material ends up being flush with the sides of the solid panel. Some embodiments may include a conventional process to achieve the flush surface, such as sanding or grinding. At step 425, a new mask pattern is applied to the first side of the solid panel. When the optional step 420 is not used, a mask application and patterning technique may be used that is compatible with a non-planar surface, for example screen printing a resist, or the application of a dry film resist that "tents" the holes. The new mask pattern is different from mask patterns previously applied to the first side, by having at least some openings that have a different size than the size of openings of previous patterns. The openings of later masks may be larger than or smaller than earlier masks. The solid panel is then sand blasted at step 430 from the side with the new mask pattern (the first side) to at least partially form the shaped cavity. Basically, a new surface level is generated with each sandblasting. The amount or type of sandblasting may vary from mask pattern to mask pattern in order to generate differing depths of surfaces. When the openings of a mask pattern are larger than a next previous mask, the depth of the earlier partially shaped cavity is increased, and a new surface is created at a shallower depth that has a shape having an outside perimeter determined by the larger mask pattern and an inside perimeter determined by the next previous mask pattern. When the openings of a mask pattern are smaller than a next previous mask, then bottom surfaces of the partly shaped cavity are lowered as determined by the openings of the smaller mask pattern. In both cases, there will be rounding of surface edges. At step 435, when a determination is made that the cavity shaping is complete, the most recently applied mask pattern is removed at step 440, and the second material may be applied a last time in order to fill the cavities, including to replace any second material that was sandblasted away during step 430. In some embodiments, the second material may be air, in which case steps 420 and 445 may not be used. Metallization is optionally applied by the fabricator at step 220 as described above with reference to FIG. 2. At step 435, when a determination is made that the cavity shaping is not complete, the process continues, and steps 415 to 435 are repeated until a determination is made at step 435 that the cavity shaping is complete.

Figure 5:
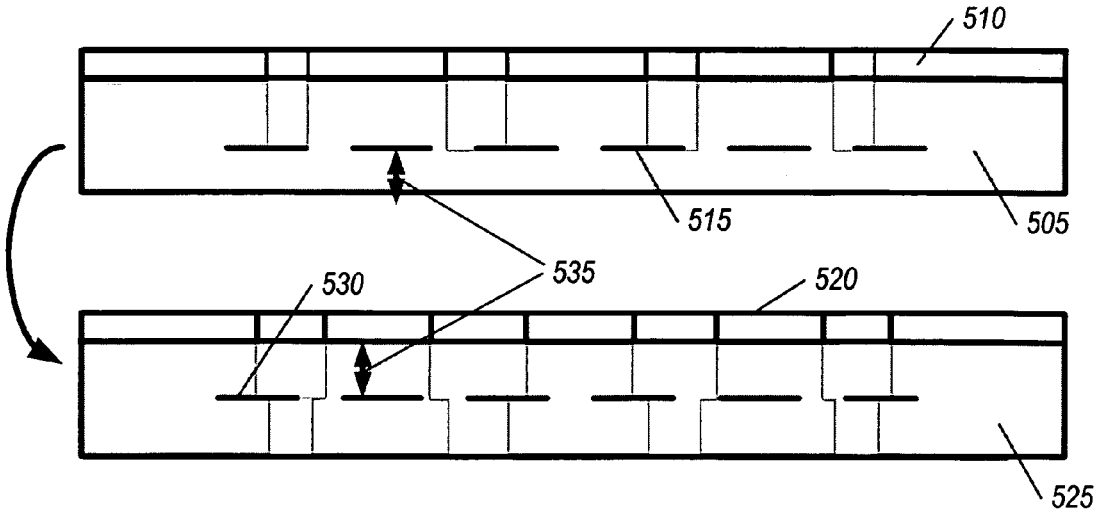
FIGS. 5-7 are cross sectional drawings of a solid panel in various stages of fabrication, in accordance with some embodiments of the present invention.

Referring to FIG. 5, a cross sectional drawing of a solid panel in two stages of fabrication is shown, in accordance with some embodiments of the present invention. In this example, a second mask pattern is used that has larger openings than a first mask pattern. The solid panel 505 is shown at a stage after a mask pattern 510 has been applied to the first side of the solid panel 505 and sandblasting through the mask pattern 510 has been completed as described with reference to FIG. 4, step 210. However, in the step of sandblasting used for these embodiments, surfaces of partially shaped cavities have been formed at level 515 (instead of the cavities going entirely through the solid panel as in FIG. 3) by using an appropriate choice of a sandblasting method and a sandblasting duration. At a subsequent stage, a new mask pattern 520 has been applied to the first side of the solid panel 525, and a second sandblasting has been performed, through the new mask pattern 520. The second sandblasting was performed using another appropriate choice of a method and a sandblasting duration that created surfaces of the shaped cavities of the new pattern at a level 530 that is a distance 535 below the first side of the solid panel 505. The surfaces of the partially shaped cavities of the earlier sandblasted pattern would therefore also have been lowered by the same amount, which brought the surfaces of the shaped cavities of the first mask pattern completely through the solid panel 525. The new mask pattern 520 can then be removed, the shaped cavities of the now textured solid panel 525 of ceramic dielectric can be filled with a second material, and the two sides of the solid panel 525 can be metallized to form a patch antenna.

Figure 6:
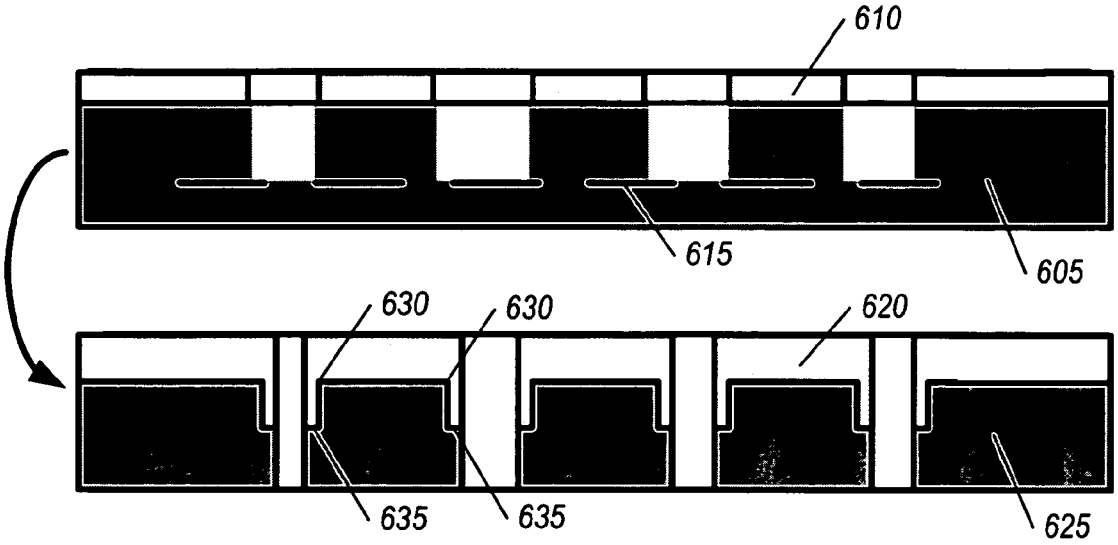

Referring to FIG. 6, a cross sectional drawing of a solid panel in two stages of fabrication is shown, in accordance with some embodiments of the present invention. In this example, a second mask pattern is used that has smaller openings than a first mask pattern. The solid panel 605 is shown at a stage after a mask pattern 610 has been applied to the first side of the solid panel 605 and sandblasting has been completed as described with reference to FIG. 4, step 210. In the step of sandblasting used for these embodiments, surfaces of partially formed shaped cavities have been formed at a level 615 by using an appropriate choice of a sandblasting method and a sandblasting duration. At a subsequent stage, a new mask pattern 620 has been applied to the first side of the solid panel 625, and a second sandblasting has been performed, through the new mask pattern 620. The new mask pattern 620 has smaller openings than the original mask pattern, which means that the masking part of the mask pattern extends over the edges 630 of the larger openings, and the masking material and process needs to be designed to get the material down the vertical portion of the partly shaped cavity walls. This aspect of these embodiments may be more difficult to control than related aspects of other embodiments described herein. The second sandblasting was performed using another appropriate choice of a sandblasting method and a sandblasting duration that created surfaces of the shaped cavities formed by the new mask pattern that are at a level that is below the second side of the solid panel 605. The protected surfaces 635 of the shaped cavities formed by the sandblasting of the earlier mask pattern 610 are not lowered in this embodiment, which may be a difference that makes this embodiment beneficial in some instances. The new mask pattern 620 can then be removed, the shaped cavities of the now textured solid panel 625 of ceramic dielectric can be filled with a second material, and the two sides of the solid panel 625 can be metallized to form a patch antenna.

Figure 7:
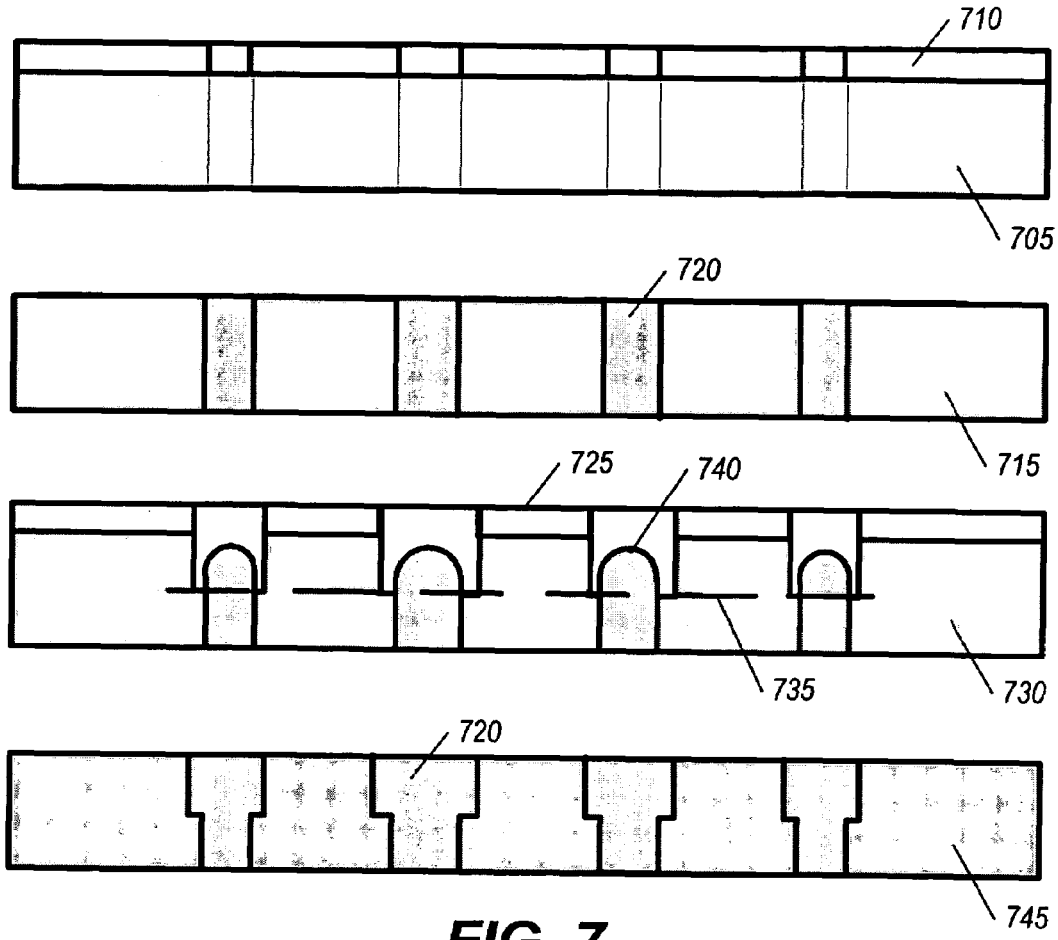

Referring to FIG. 7, a cross sectional drawing of a solid panel in four stages of fabrication is shown, in accordance with some embodiments of the present invention. In this example, as in the example described with reference to FIG. 5, a second mask pattern is used that has larger openings than a first mask pattern. The solid panel 705 is shown at a stage after a mask pattern 710 has been applied to the first side of the solid panel 705 and sandblasting has been completed as described with reference to FIG. 4, step 210. In the step of sandblasting used for these embodiments, the partially shaped cavities are sandblasted entirely through the solid panel (as in FIG. 3) by using an appropriate choice of a sandblasting method and a sandblasting duration. At a second stage, the partially shaped cavities of the solid panel 715 have been filled with a second material 720. At a third stage, a new mask pattern 725 having larger openings than the first mask pattern 710 has been applied to the first side of the solid panel 730, and a second sandblasting has been performed, through the new mask pattern 725. The second sandblasting was performed using another appropriate choice of a sandblasting method and a sandblasting duration that created surfaces, of the shaped cavities formed by the new mask pattern at a level 735. The second material that was used to fill the partly shaped cavities has also been ablated by the sandblasting process, as indicated by the top surfaces 740 of the second material in FIG. 7. At a fourth stage, the new mask pattern has been removed and the shaped cavities of the solid panel 745 have been refilled with the second material 720. The two sides of the solid panel 745 can be metallized to form a patch antenna.

Figure 8:
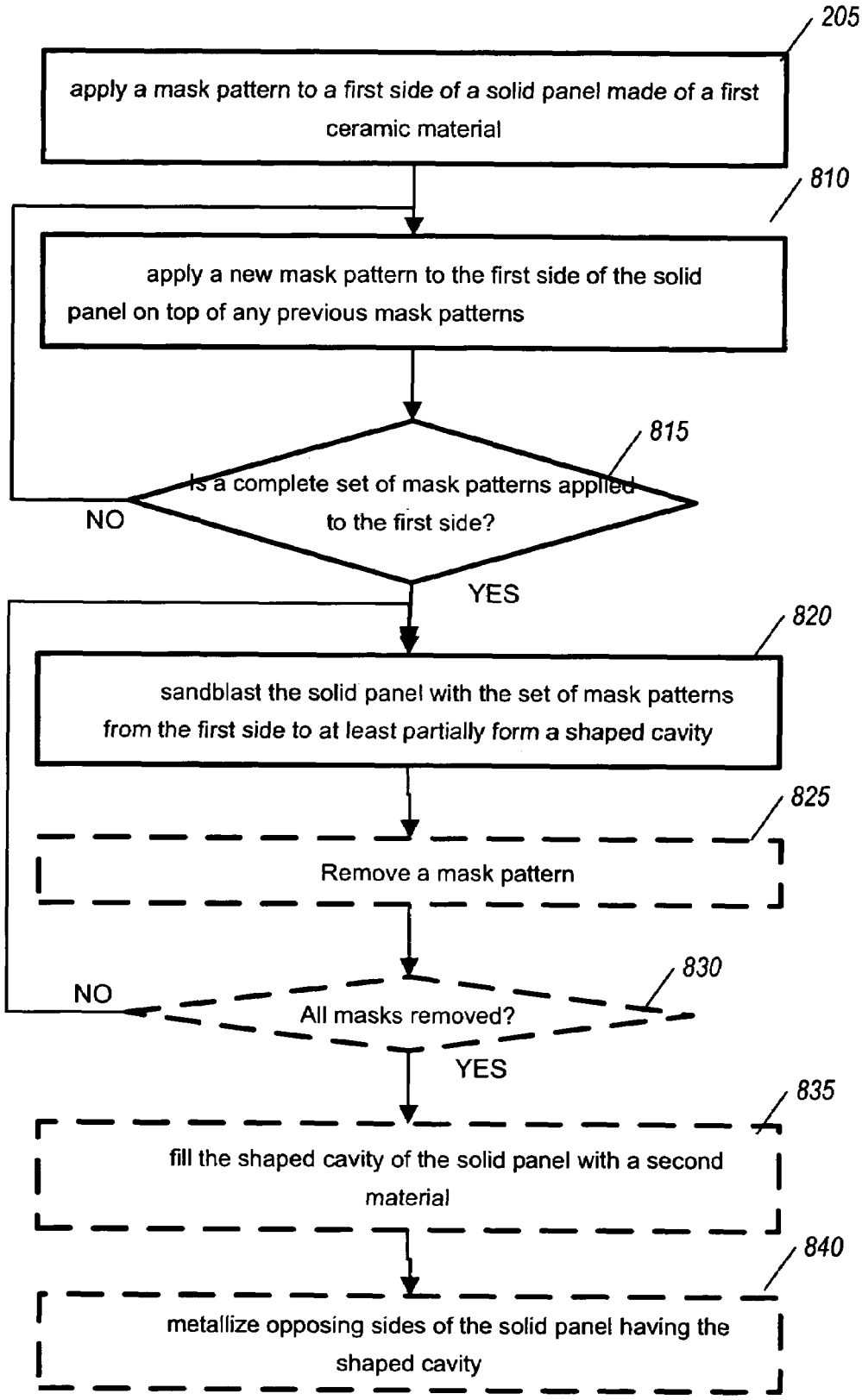
FIG. 8 is a flow chart that shows some steps of methods used to fabricate a textured dielectric patch antenna, in accordance with some embodiments of the present invention.

Referring to FIG. 8, some steps of methods used to fabricate a textured dielectric patch antenna are shown, in accordance with some embodiments of the present invention. Step 205 is performed as described with reference to FIG. 2, using materials as described with reference to FIG. 3. At step 810, a new mask pattern is applied on top of a most recent mask pattern, from which it follows that a second mask pattern is applied on top of the first mask pattern when step 810 directly follows step 205. At step 815, a determination is made whether a complete set of mask patterns has been applied to the first side of the solid panel. A complete set of mask patterns is a set of mask patterns determined during a design process, and may be a set of patterns sufficient to completely define the shaped cavities of the ceramic dielectric (solid panel) that are to be filled with a second material to form the textured dielectric of a patch antenna. When the determination is negative, the process continues at step 810, where a new mask pattern is applied on top of a most recent mask pattern. When the determination is positive at step 815, sandblasting is performed at step 820 using methods, materials, and durations determined during a design process to at least partially form the shaped cavities. In some embodiments, the mask patterns are made of materials that are selectively soluble (for example, by using a photoresist material and a photo dielectric material, the photoresist material being soluble in organic solvents or aqueous solutions that do not dissolve the photo dielectric material). Optional step 825 is then performed to remove the uppermost mask pattern using the solvent that removes the upper mask pattern but not the one underneath it. At optional step 830 a determination is made whether all mask patterns have been removed. When the determination is negative, the steps of sandblasting 820 and mask pattern removal are repeated until the determination is positive. In some embodiments, the sandblasting and mask pattern material are designed so that ceramic material of the solid panel and the presently exposed mask pattern material are simultaneously removed by the ablation of the sandblasting. For example, the mask patterns may be formed of a metal such as copper or a ceramic-filled polymer that is ablated by sandblasting, but typically at a rate slower than the ablation rate of the ceramic dielectric solid panel. In the embodiments in which the mask patterns are removed by simultaneous ablation, the optional steps 825 and 830 may not be necessary, since one sandblasting step may be used. When the optional determination is positive at step 836, or the simultaneous ablation process is used at step 820, one or more shaped cavities have been formed and they may be filled with a second material at step 835, and metallization of the two sides of the solid panel may be performed at step 840. When the embodiments use the solvent removal of mask patterns, the mask patterns may be designed so that the mask portion of an upper mask pattern is larger than the mask portions of all mask patterns below it. When the embodiments use the simultaneous ablation, the mask patterns may be designed so that the mask portion of an upper mask pattern is smaller than the mask portions of all mask patterns below it.

Figure 9:
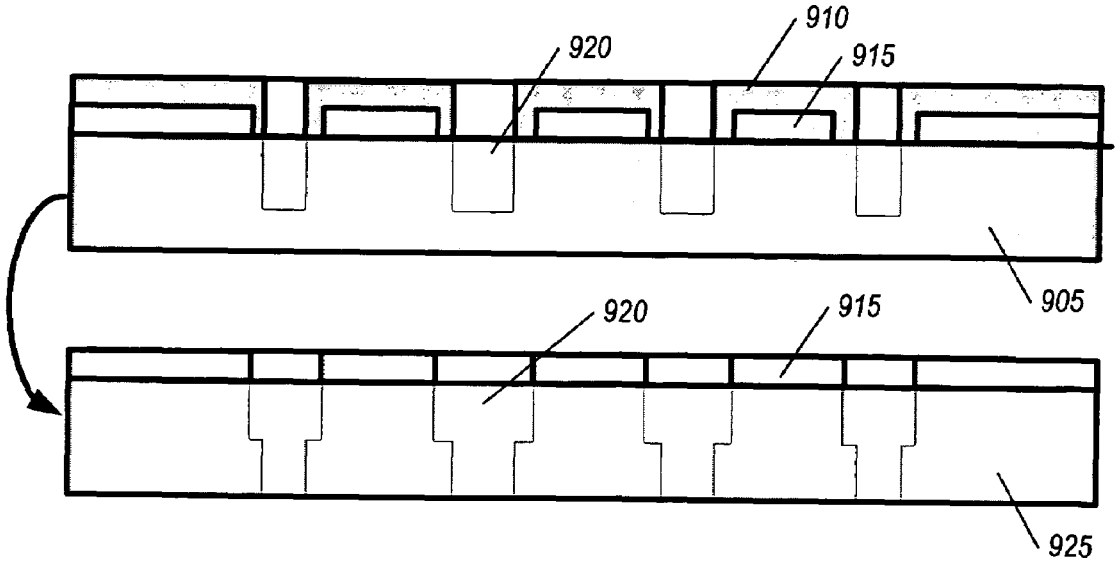
FIG. 9 is a cross sectional drawing of a solid panel in two stages of fabrication, in accordance with some embodiments of the present invention.

Referring to FIG. 9, a cross sectional drawing of a solid panel in two stages of fabrication is shown, in accordance with some embodiments of the present invention. In this example, a solid panel 905 at a first stage has a second mask pattern 910 formed over a first mask pattern 915 and sandblasting has been performed through the first mask pattern 915 from the first side of the solid panel 905 to form partially shaped cavities 920. The mask portions of the second mask pattern 910 are larger than the mask portions of the first mask pattern 915. At a second stage, the solid panel 925 has had the second mask pattern 910 selectively removed using a solvent and the shaped cavities have been formed by a second sandblasting process through the second mask pattern 910 from the first side of the solid panel 925. The first mask pattern 915 can then be removed, the shaped cavities of the now textured solid panel 925 of ceramic dielectric can be filled with a second material, and the two sides of the solid panel 925 can be metallized to form a patch antenna.

Figure 10:
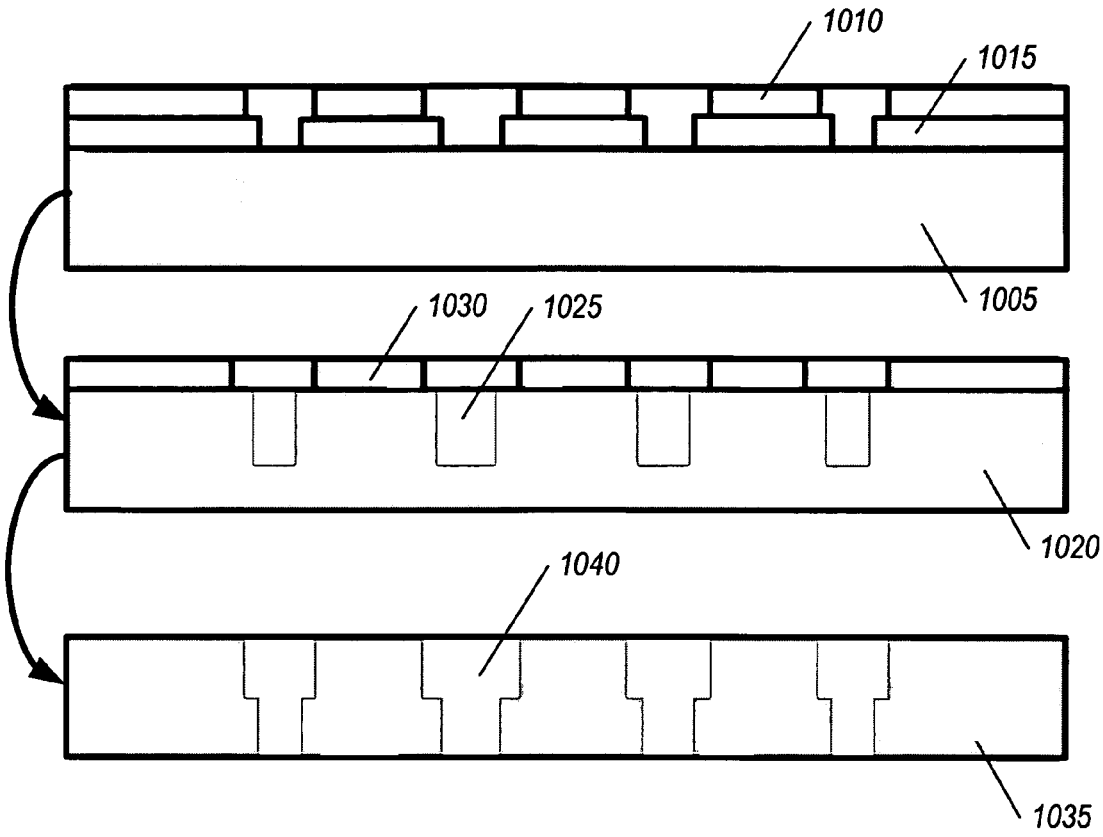
FIG. 10 is a cross sectional drawing of a solid panel in three stages of fabrication, in accordance with some embodiments of the present invention.

Referring to FIG. 10, a cross sectional drawing of a solid panel in three stages of fabrication is shown, in accordance with some embodiments of the present invention. In this example, a solid panel 1005 at a first stage has a second mask pattern 1010 formed over a first mask pattern 1015. The mask portions of the second mask pattern 1010 are smaller than the mask portions of the first mask pattern 1015. The solid panel 1020 at a second stage has been sandblasted to form partially shaped cavities 1025. The sandblasting has ablated the second mask pattern 1010, and portions of the first mask pattern 1015, such that the remainder 1030 of the first mask pattern is essentially equivalent to the original form of the second mask pattern 1010, and partially shaped cavities have been formed based on the first mask pattern 1015. At a third stage, the solid panel 1035 has had the remainder 1030 of the first mask pattern removed by continued sandblasting and the shaped cavities 1040 have been formed, having shapes that replicate the original mask patterns. The shapes of the shaped cavities are expanded or contracted in height relative to the heights of the mask patterns in proportion to relative ablation rates of the mask patterns versus the ceramic dielectric material. The shaped cavities of the now textured solid panel 1035 of ceramic dielectric can be filled with a second material, and the two sides of the solid panel 1035 can be metallized to form a patch antenna.

Figure 11:
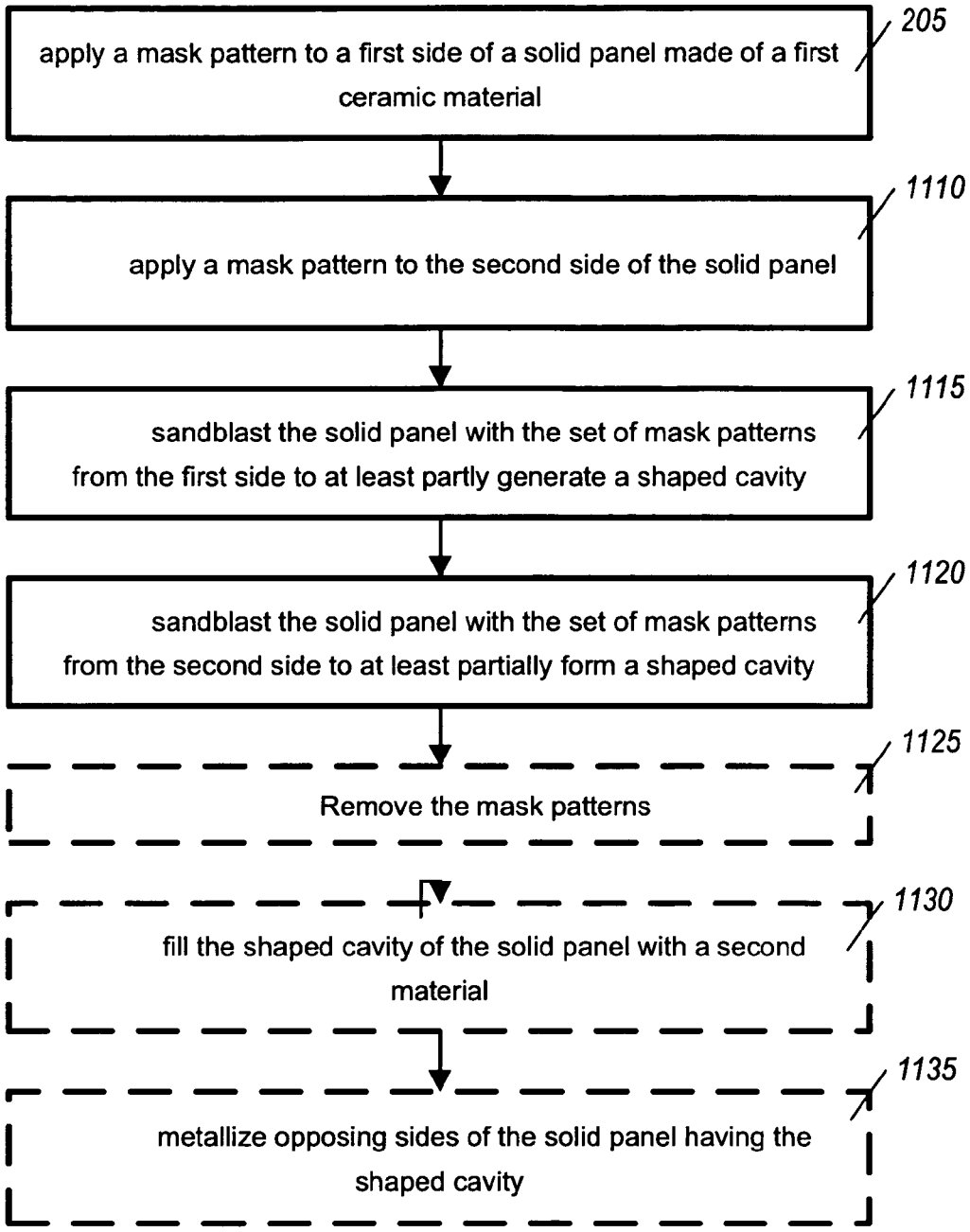
FIG. 11 is a flow chart that shows some steps of methods used to fabricate a textured dielectric patch antenna, in accordance with some embodiments of the present invention.

Referring to FIG. 11, some steps of methods used to fabricate a textured dielectric patch antenna are shown, in accordance with some embodiments of the present invention. Step 205 is performed as described with reference to FIG. 2, using materials as described with reference to FIG. 3. At step 1110, a new mask pattern is applied to the second side of the solid panel. At step 1115, the solid panel is sandblasted through the first mask pattern from the first side to at leasts partially form one or more shaped cavities. At step 1120, the solid panel is sandblasted through the new mask pattern from the second side to form the one or more shaped cavities. The mask patterns may be removed at optional step 1125, or they may have been removed by ablation, as in the method described with reference to FIGS. 9 and 10. At optional step 1130, the shaped cavities may be filled with a second material, and at step 1135, the two sides of the solid panel may be metallized. These embodiments have the advantage of applying two mask patterns to flat sides of the solid panel, which increases the number of available mask patterning techniques from which to select and allows simultaneous removal of the mask patterns, but does require alignment of the masks on opposite sides of the solid panel.

Figure 12:
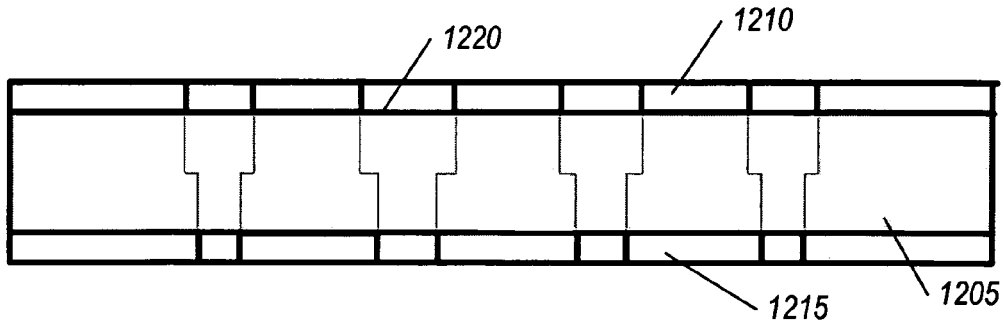
FIG. 12 is a cross sectional drawing of a solid panel in one stage of fabrication, in accordance with some embodiments of the present invention.

Referring to FIG. 12, a cross sectional drawing of a solid panel in one stage of fabrication is shown, in accordance with some embodiments of the present invention. In this example, a solid panel 1205 at a first stage has a first mask pattern 1210 formed on a first side of the solid panel 1205 and a second mask pattern 1215 formed on a second side of the solid panel 1205. The first and second mask patterns are different. Sandblasting has been performed from each side of the solid panel, forming shaped cavities 1220. The two mask patterns 1210, 1215 may be simultaneously removed using a solvent, the shaped cavities 1220 of the now textured solid panel 1205 of ceramic dielectric can be filled with a second material, and the two sides of the solid panel 1205 can be metallized to form a patch antenna.

Figure 13:
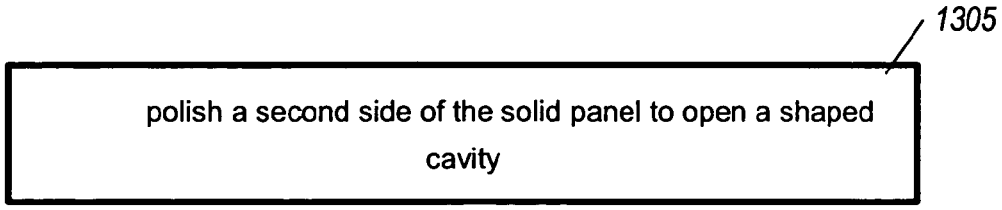
FIG. 13 is a flow chart that shows a step used in methods for fabricating a textured dielectric patch antenna, in accordance with some embodiments of the present invention.

Referring to FIG. 13, a step used in methods for fabricating a textured dielectric patch antenna is shown, in accordance with some embodiments of the present invention. For embodiments in which sandblasting is performed from only one side, such as embodiments that have been described with reference to FIGS. 2-9, and when in those embodiments one or more cavities are designed to extend entirely through the solid panel, the embodiments may be modified so that when all the sandblasting steps are completed, no cavities are extending all the way through the solid panel. Those cavities that are to be extended all the way through are partially shaped to have a common depth that is slightly less than the thickness of the ceramic dielectric solid panel. A step 1305 of polishing the second side of the solid panel is performed to cause the desired cavities to extend through the solid panel. The step of polishing 1305 is performed before the optional step of filling 215, 445, 845.

Patch antennas formed using the techniques as described herein can be included in a very wide variety of radio frequency devices, including cellular radios, broadcast receivers, and wireless routers.

In the foregoing specification, the invention and its benefits and advantages have been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims.

What is claimed is:

1. A method of fabricating a textured dielectric patch antenna, comprising:

applying a first mask pattern to a first side of a solid panel made of a first material that is a ceramic dielectric;

sandblasting the solid panel through the first mask pattern from the first side to at least partially form a shaped cavity; and metallizing opposing sides of the solid panel having the shaped cavity.

2. The method according to claim 1, further comprising:

connecting the metallization on one of the opposing sides to an isolated electronic connection node on the other side.

3. The method according to claim 1, wherein at least a portion of the shaped cavity extends all the way through the solid panel, the method further comprising:

forming a plated through hole in material that fills the shaped cavity, the plated through hole connecting the metallization on one of the opposing sides to an isolated electronic connection node on the other side.

4. The method according to claim 1, further comprising:

removing a most recently applied mask pattern from the solid panel after sandblasting;

applying a new mask pattern to a side of the solid panel, wherein the new mask pattern is different from mask patterns previously applied to that side; and sandblasting the solid panel from the side with the new mask pattern to at least partially form the shaped cavity.

5. The method according to claim 4, further comprising filling partially generated shaped cavities with a second material after removing the most recently applied mask pattern from the solid panel and before applying the new mask pattern.

6. The method according to claim 1, further comprising: applying a second mask pattern on the first side over the first mask pattern before the sandblasting.

7. The method according to claim 6, further comprising:

sandblasting the solid panel having both the first and second mask patterns from the first side to at least partially form the shaped cavity; and removing the second mask pattern after the sandblasting.

8. The method according to claim 6, further comprising: sandblasting the solid panel having both the first and second mask patterns from the first side to at least partially form the shaped cavity while ablating the first and second mask patterns.

9. The method according to claim 1, further comprising applying a second mask pattern on a second side of the solid panel; and sandblasting the solid panel through the second mask pattern from the second side to at least partially form the shaped cavity.

10. The method according to claim 1, further comprising filling the shaped cavity of the solid panel with a second material.

11. The method according to claim 10, wherein the first ceramic material has a first dielectric constant and the second material has a second dielectric constant substantially different from the first dielectric constant.

12. The method according to claim 10, wherein the first ceramic material has a dielectric constant greater than 50 and the second material has a dielectric constant less than 20.

13. The method according to claim 10, wherein the second material is one of a liquid, a B-stage solid polymer, a ceramic filled polymer, or a formed ceramic.

14. The method according to claim 1, further comprising polishing the second side of the solid panel until an opening to a second side of the solid panel is formed.

* * * * *